US005904009A

United States Patent [19]

Huang

[11] Patent Number: 5,904,009

[45] Date of Patent: May 18, 1999

[54] SHOCK-RESISTANT FLOOR-SUPPORTING STRUT UNIT WHICH CAN BEAR A HEAVY LOAD THEREON

[76] Inventor: Chien-Teh Huang, Fan-Po-Lin No. 47-1, San-Chi Hsiang, Taipei Hsien, Taiwan

[21] Appl. No.: 08/982,215

[22] Filed: Dec. 1, 1997

[51] Int. Cl.[6] ..... E04B 9/00

[52] U.S. Cl. ..... 52/126.6; 52/126.4; 52/263

[58] Field of Search ..... 52/126.1, 126.4, 52/126.5, 126.6, 126.7, 263

[56] References Cited

U.S. PATENT DOCUMENTS 3,222,030 12/1965 Thorpe ..... 52/126.6 X
5,477,649 12/1995 Bessert ..... 52/126.6 X

*Primary Examiner*—Creighton Smith
*Attorney, Agent, or Firm*—Knobbe, Martens, Olson & Bear, LLP

[57] ABSTRACT

A floor-supporting strut unit includes a vertical tube fixed on a base, and a cap for covering an open upper end of the vertical tube. An externally threaded vertical rod extends threadably through a threaded hole in the cap and a stop nut which is supported by the cap. A top plate is fixed on the upper end of the vertical rod.

7 Claims, 10 Drawing Sheets

SHOCK-RESISTANT FLOOR-SUPPORTING STRUT UNIT WHICH CAN BEAR A HEAVY LOAD THEREON

BACKGROUND OF THE INVENTION

1. Field of the Invention

This invention relates to a plurality of supporting strut units which support cooperatively a plurality of floorboard units thereon side by side to bear heavy machinery, such as bulky computer equipment, more particularly to shock-resistant floor-supporting strut units which can bear a relatively heavy load thereon.

2. Description of the Related Art

Referring to FIGS. 1, 2 and 3, a plurality of conventional floor-supporting strut units 2 stand on a horizontal surface or the ground 1 to interconnect a plurality of rectangular horizontal tubes 4 which support a plurality of floorboard units 3 that constitute cooperatively a modular floor unit for placing bulky computer equipment thereon. As such, numerous electrical cords can extend between the ground 1 and the floorboard units 3 in order to maintain a neat surrounding for the computer equipment. Each of the strut units 2 includes a base 21 having a fixed vertical tube 22, a generally circular top plate 23, an externally threaded vertical rod 24 having an upper end secured to the top plate 23, a nut 25 engaging threadably the threaded vertical rod 24 and having a bottom seated on the open upper end of the vertical tube 22, and a cover member 26 for covering the top plate 23. Each of the top plates 23 has four angularly equidistant coupling units, each of which includes two open-ended parallel slots 230, 231 formed in an outer peripheral portion thereof to define a connecting plate section 232 that is inserted into the corresponding tube 4 so as to permit a lock bolt (Bl) to extend through a through-hole 42 in a top wall of the corresponding tube 4 and a fastener hole 233 in the connecting plate section 232 to engage a lock nut (N1), thereby locking the tube 4 on the top plate 23. As best shown in FIGS. 2 and 3, each of the tubes 4 has two parallel side walls 40, 41 which are inserted into two slots 230, 231 of the top plate 23. Each of the covers 26 has four notches 260 so that the top wall of each of the tubes 4 is located in one of the notches 260 of the covers 26. The conventional strut units 2 suffers from the following disadvantages:

(1) Because the vertical tubes 22 have an outer diameter which can only be approximate to that of the nuts 25, as shown in FIG. 2, the loading capacity of the strut units 2 is limited.

(2) Shock resulting from the operation or movement of the computer equipment easily breaks the vertical tubes 22.

(3) The connecting plate sections 232 easily deform due to the fact that the top plates 23 support the tubes 4 only by means of the connecting sections 232.

(4) The floorboard units 3 easily deform at centers thereof due to the fact that the centers of the units 3 are far from the top plates 23.

SUMMARY OF THE INVENTION

An object of this invention is to provide a floor-supporting strut unit with a diameter-increased vertical tube which can bear a relatively heavy load.

Another object of this invention is to provide a shock-resistant floor-supporting strut unit.

Still another object of this invention is to provide a floor-supporting strut unit with an auxiliary plate which is constructed so as to minimize deformation of the strut unit and floorboard units which are supported by the strut units.

According to this invention, a floor-supporting strut unit includes a vertical tube fixed on a base, and a cap for covering an open upper end of the vertical tube. An externally threaded vertical rod extends threadably through a threaded hole in the cap and a stop nut which is supported on the cap. A top plate is fixed on the upper end of the vertical rod.

Preferably, a disk spring is attached to the vertical rod and has a top abutting against a bottom of the stop nut, and a bottom abutting against a top of the cap to absorb shock from the vertical rod.

Preferably, an auxiliary plate has a threaded hole to engage the threaded vertical rod, and is located between the top plate and the stop nut. The auxiliary plate further has eight radially extending inner slots which are angularly equidistant, thereby permitting eight horizontal tubes to be bolted thereto. In this way, center of each of the floorboard units is supported on one of the horizontal tubes to prevent deformation thereof. Furthermore, because the auxiliary plate cooperates with the vertical tubes and the top plate to support the horizontal tubes, deformation of the top plate and the vertical tubes can also be minimized, thereby improving the durability of the strut unit of this invention.

BRIEF DESCRIPTION OF THE ACCOMPANYING DRAWINGS

Other features and advantages of this invention will become apparent in the following detailed description of the preferred embodiments of this invention with reference to the accompanying drawings in which.

DETAILED DESCRIPTION OF THE PREFERRED EMBODIMENTS

Figure 1:
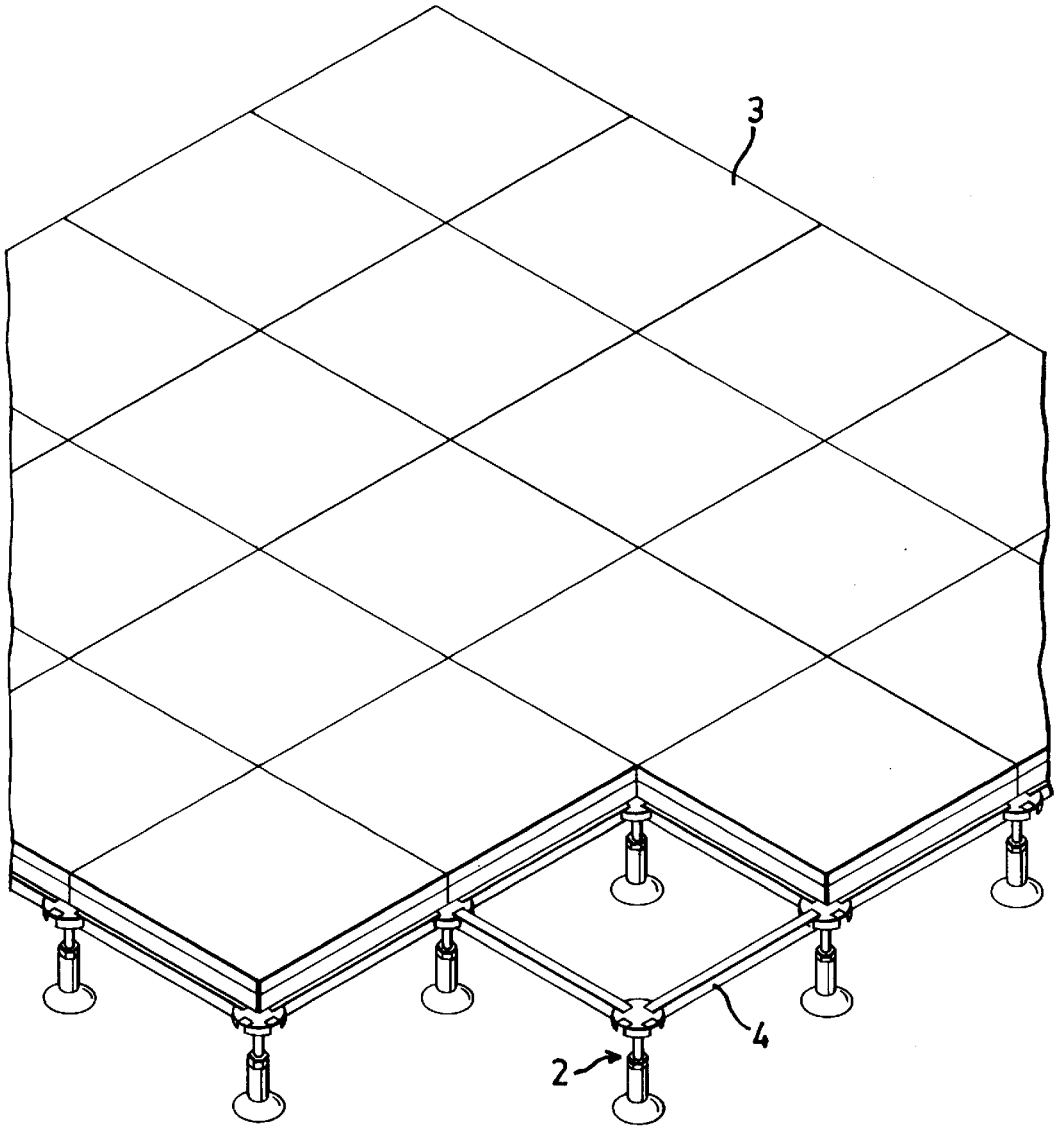
FIG. 1 PRIOR ART
FIG. 1 is a schematic view illustrating how a plurality of floorboard units are supported on a plurality of conventional floor-supporting strut units.
Figure 2:
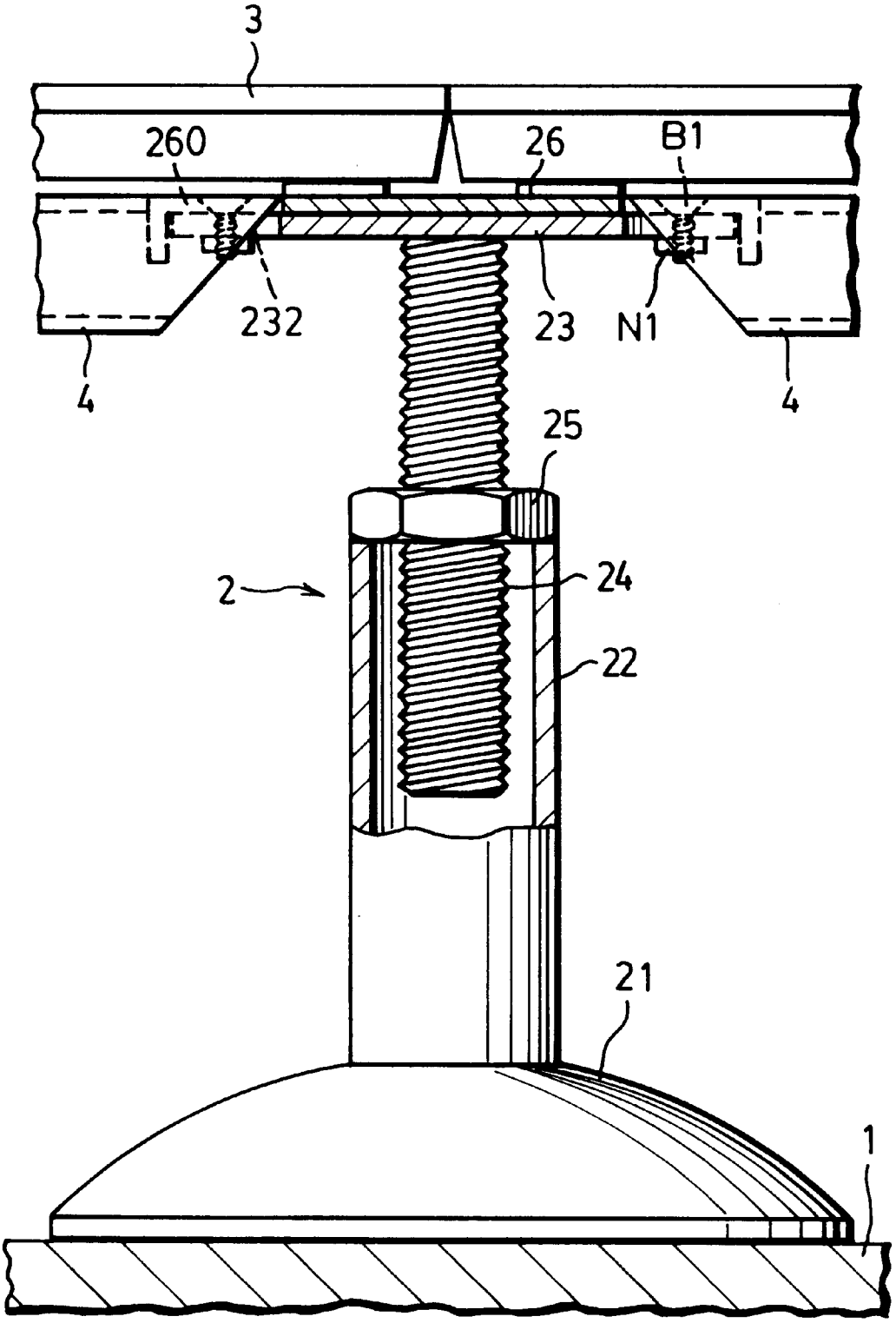
FIG.2 PRIOR ART
FIG. 2 is a schematic view illustrating how two horizontal tubes are interconnected by means of one of the conventional floor-supporting strut units.
Figure 3:
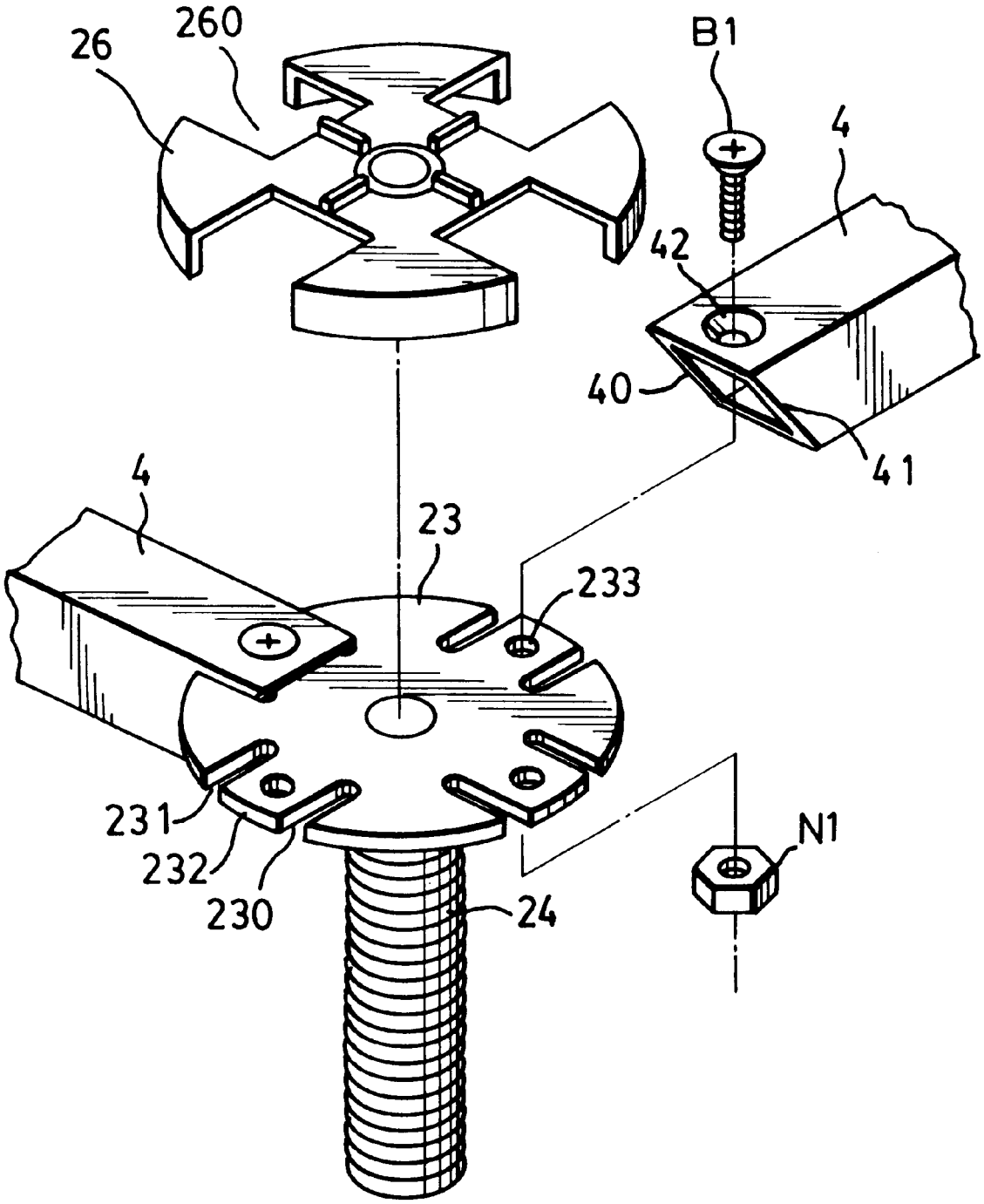
FIG. 3 PRIOR ART
FIG. 3 is a partly exploded view of an upper portion of the conventional floor-supporting strut unit of FIG. 2, shown together with the end portions of two horizontal tubes.
Figure 4:
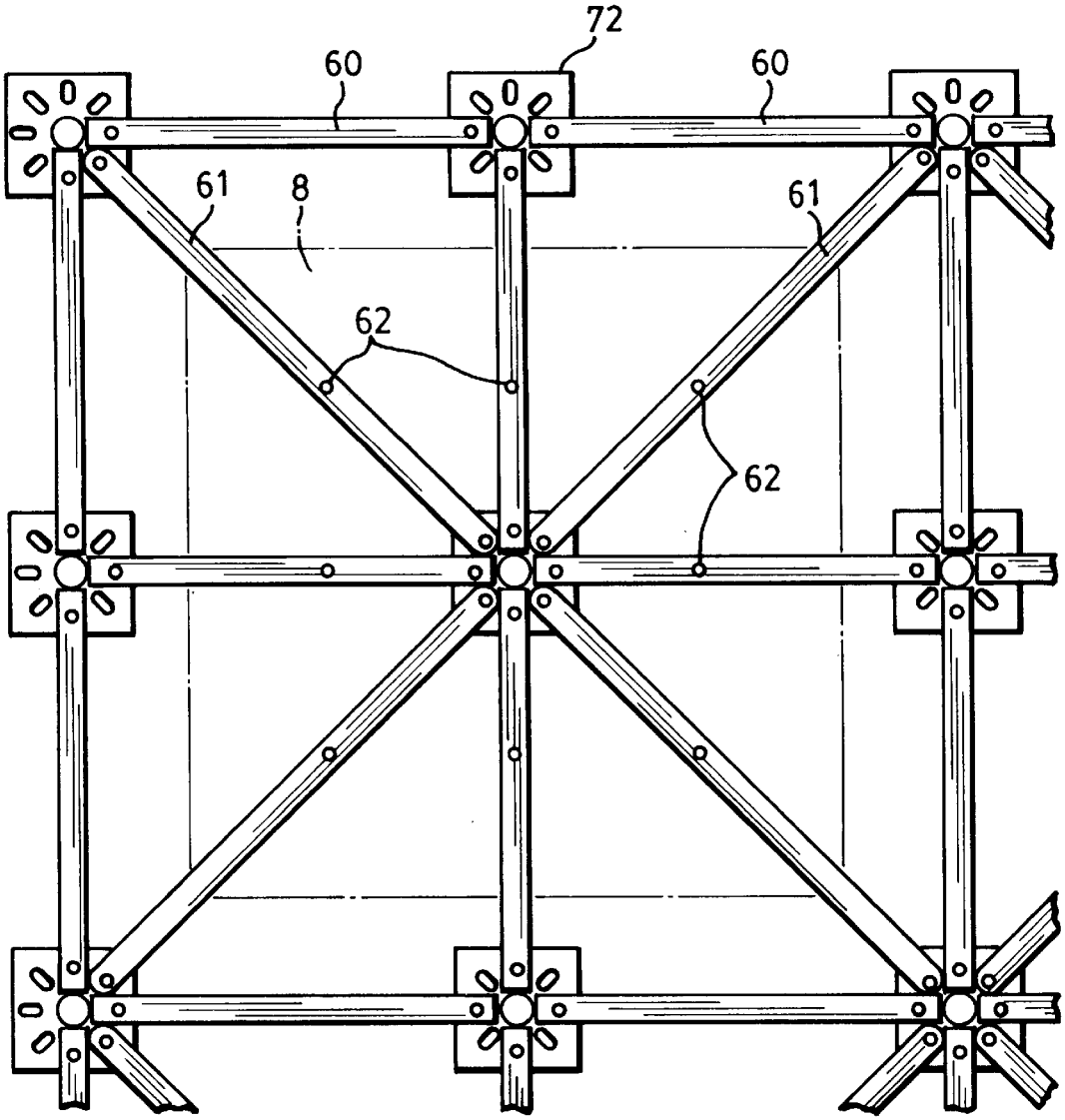
FIG. 4 is a schematic top view illustrating how a plurality of floor-supporting strut units are used in accordance with this invention.
Figure 5:
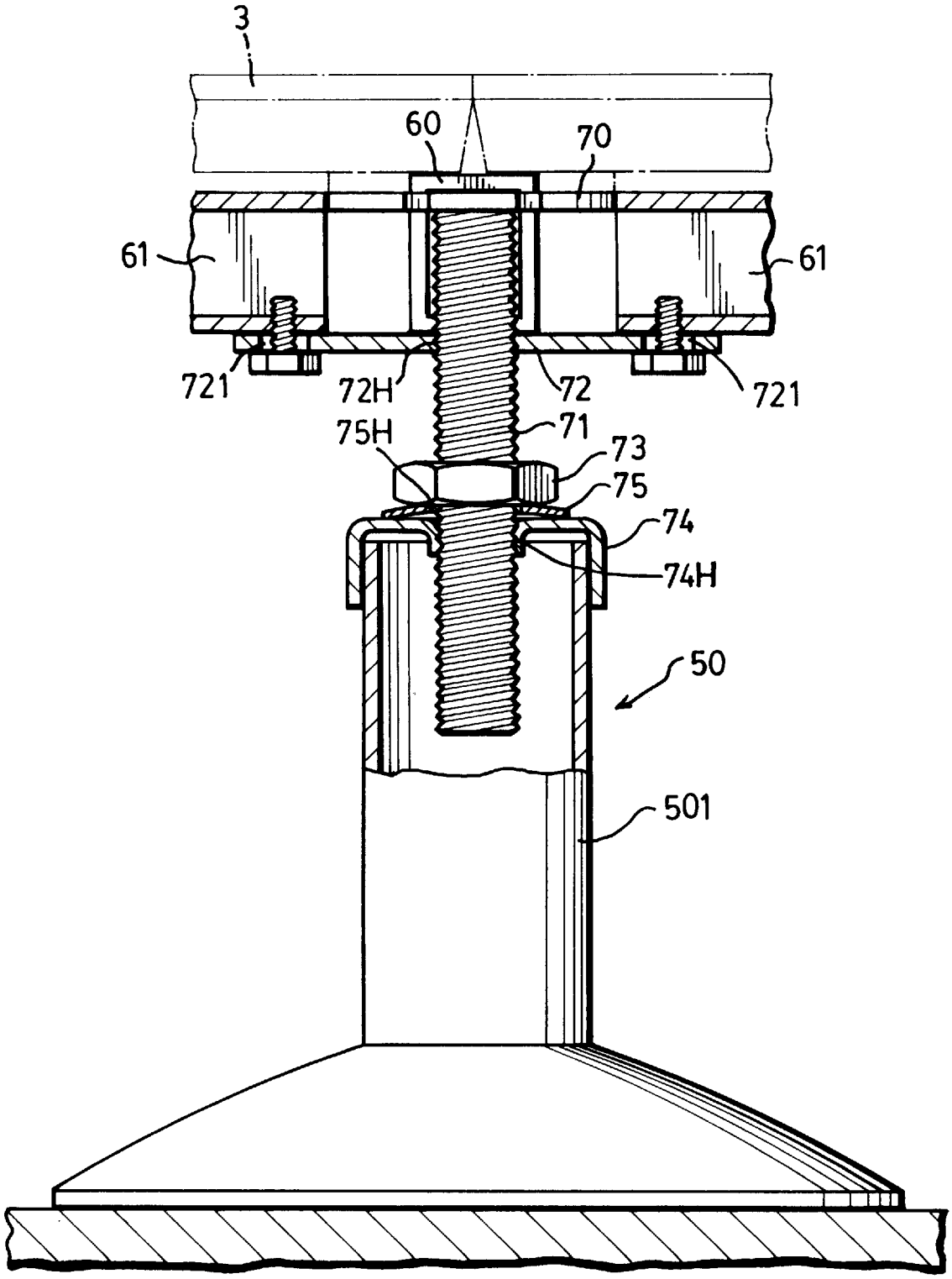
FIG. 5 is a partly sectional view illustrating how two horizontal tubes are interconnected by means of a first preferred embodiment of a floor-supporting strut unit according to this invention.
Figure 6:
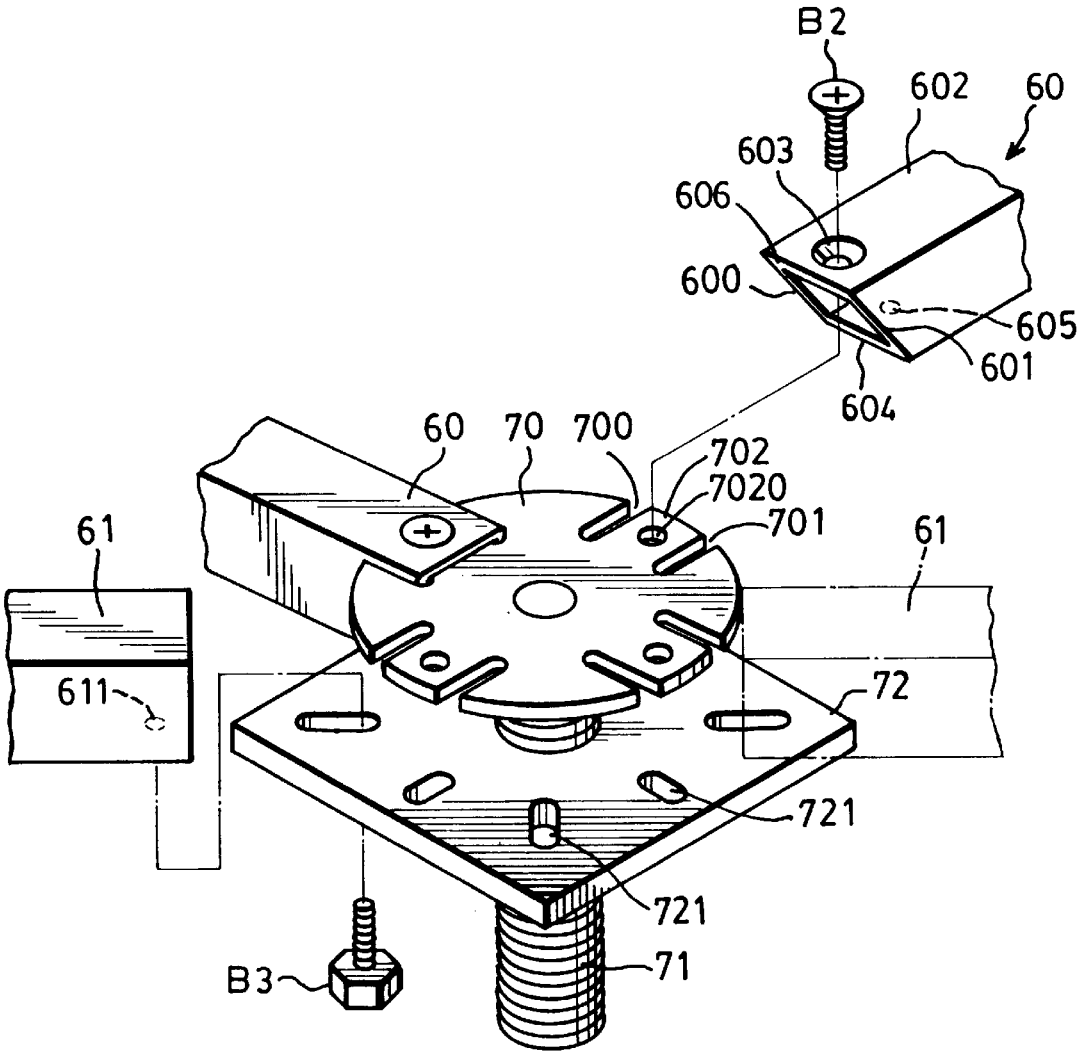
FIG. 6 is a partly exploded view of an upper portion of the first preferred embodiment of this invention, shown together with the end portions of two horizontal tubes.

Referring to FIGS. 4, 5 and 6, a first preferred embodiment of a floor-supporting strut unit according to this invention is shown to include a base 50 having a fixed vertical tube 501, a generally circular top plate 70, an externally threaded vertical rod 71 secured to and below the center of the top plate 70 in a known manner, a rectangular auxiliary plate 72, a stop nut 73, a cap 74 and a disk spring 75.

The top plate 70 has four angularly equidistant coupling units, each of which has two parallel outer slots 700, 701 between which a connecting plate section 702 is defined. Each of the connecting plate sections 702 has a fastener hole 7020 formed therethrough. As illustrated, each of the top plates 70 can be coupled with four main horizontal tubes 60, each of which has two parallel, vertical side walls 600, 601, a horizontal top wall 602 formed with a through-hole 603, a horizontal bottom wall 604 formed with a threaded hole 605, and an inclined end surface 606. The side walls 600, 601 of each of the main horizontal tubes 60 are inserted respectively into two outer slots 700, 701 in the corresponding top plate 70 so as to permit a bolt (B2) to extend through the through-hole 603 in the top wall 602 and the corresponding fastener hole 7020 in the corresponding top plate 70 to engage a nut (not shown) in a known manner.

In the strut unit according to the first preferred embodiment, the threaded vertical rod 71 extends downward through a threaded hole 72H in the auxiliary plate 72, the stop nut 73, a central bore 75H of the disk spring 75 and a threaded hole 74H in the cap 74 and into the open end of the vertical tube 501 of the base 50. The spring 75 abuts against a bottom of the stop nut 73 at a top thereof and a top of the cap 74 at a bottom thereof, thereby supporting the assembly of the stop nut 73 and the vertical rod 71 on the spring 75, which is supported on the cap 74 and the base 50.

Each of the rectangular auxiliary plates 72 has eight radially extending inner slots 721 which are angularly equidistant. Four auxiliary horizontal tubes 61 (only two are shown in FIG. 6) can be locked respectively on the corresponding auxiliary plate 72 by means of four bolts (B3) (only one is shown in FIG. 6), each of which extends through the corresponding inner slot 721 in a respective corner of the corresponding auxiliary plate 72 to engage a threaded hole 611 in a bottom wall of the auxiliary horizontal tube 61. In the same way, four main horizontal tubes 60 can be locked on one of the auxiliary plates 72.

In FIG. 5, because the cap 74 is interposed between the open upper end of the vertical tube 501 and the stop nut 73 to support the latter, the outer diameter of the vertical tube 501 can be designed to be much larger than that of the stop nut 73, thereby increasing significantly the loading capacity of the floor-supporting strut unit of this invention. Consequently, very heavy mechanical equipment 8 (see FIG. 4) can be supported firmly on the strut units of this invention.

When the operation or movement of the equipment 8 (see FIG. 4) vibrates the vertical rods 71, the shock of the vertical rods 71 can be absorbed by the spring 75, thereby increasing the durability of the strut units of this invention.

As illustrated in FIG. 4, because one auxiliary horizontal tube 61 can be provided between two auxiliary plates 72, the deformation of the floorboard units (not shown) supported thereby can be minimized.

Figure 7:
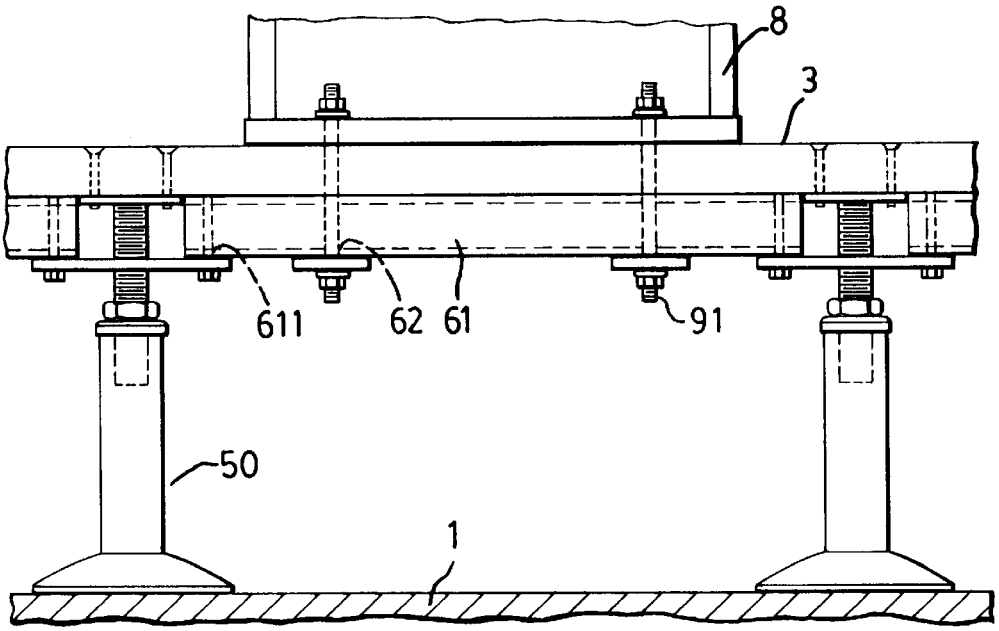
FIGS. 7 and 8 illustrate two alternative manners in which bulky mechanical equipment is fixed on the first embodiment of this invention.

Referring to FIG. 7, in use, the mechanical equipment 8 can be supported indirectly on the strut units of this invention by means of a plurality of long bolts 91 which extend through a floor unit 3, consisting of a plurality of floorboard units, and holes 62 in the auxiliary horizontal tubes 61.

Figure 8:
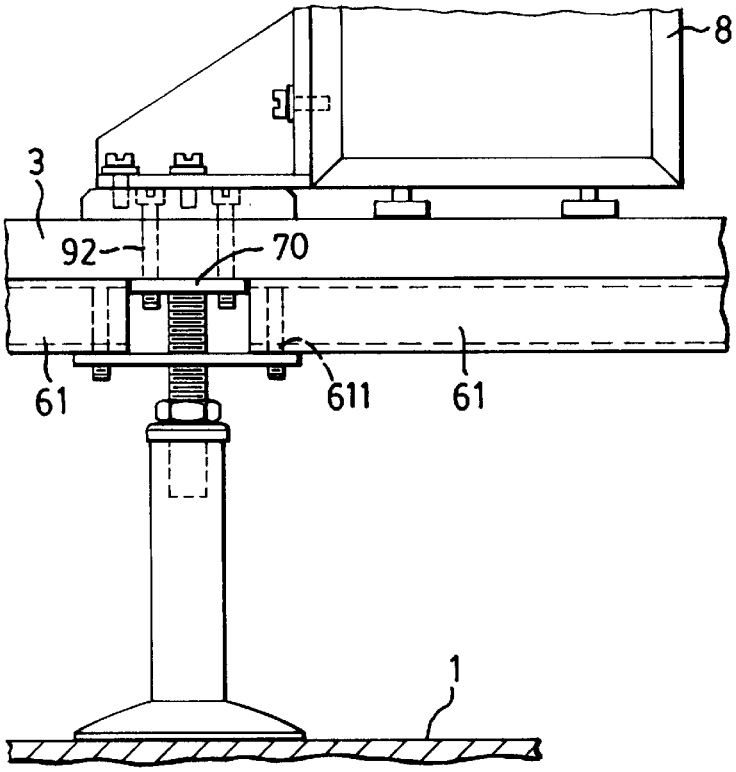

Alternatively, as illustrated in FIG. 8, the mechanical equipment 8 can be fixed directly on the strut units of this invention by a plurality of short bolts 92 which extend through the floor unit 3 and the top plate 70.

Figure 9:
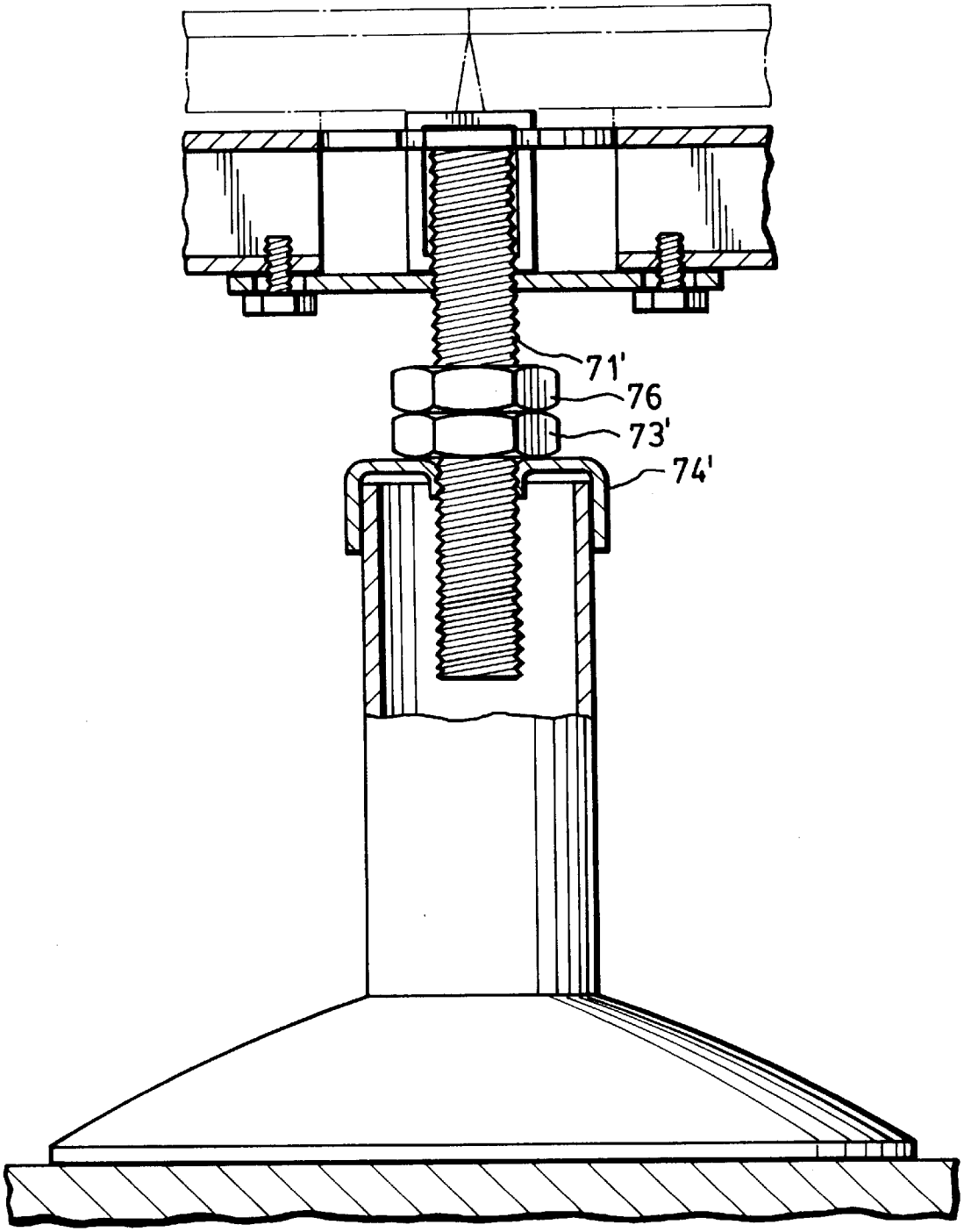
FIG. 9 is a schematic view illustrating how two horizontal tubes are interconnected by means of a second embodiment of a floor-supporting strut unit according to this invention.

FIG. 9 shows a second preferred embodiment of this invention which is similar to the first embodiment in construction except for the omission of the spring 75 of the first embodiment and the provision of an auxiliary nut 76 in the second embodiment. As illustrated, in this embodiment, a stop nut 73' abuts against a cap 74'. The auxiliary nut 76 engages threadably a threaded vertical rod 71' and has a bottom which is seated on a top of the stop nut 73', thereby preventing the movement of the stop nut 73' relative to the vertical rod 71'.

Figure 10:
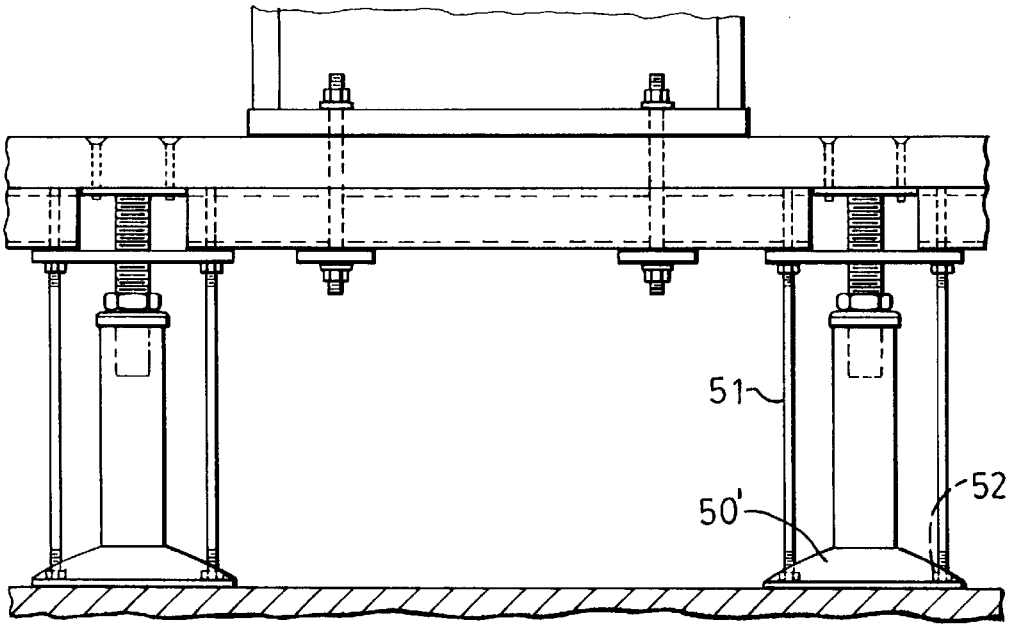
FIGS. 10 and 11 show a third preferred embodiment of this invention.
Figure 11:
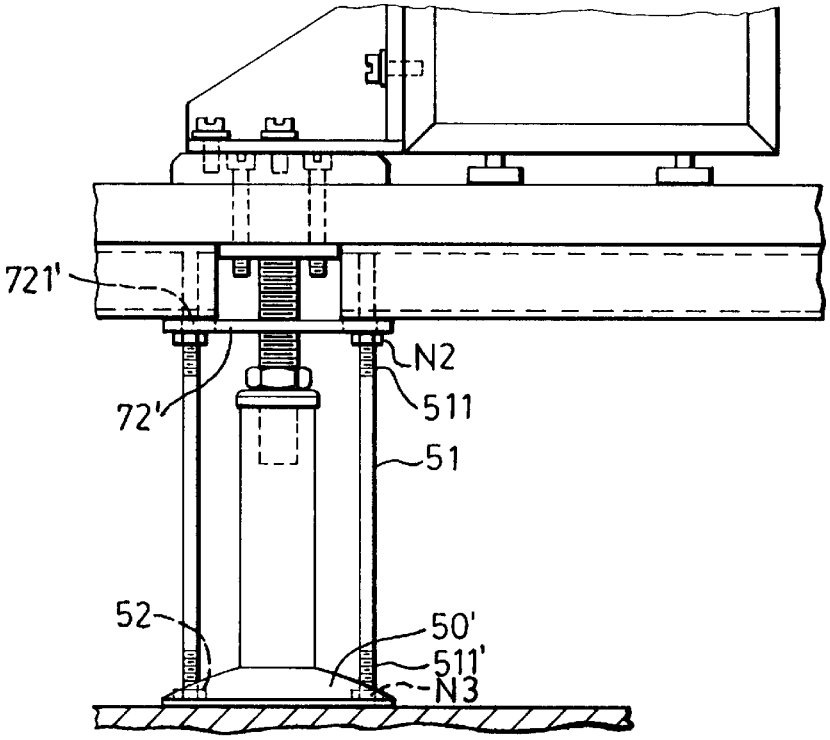

FIGS. 10 and 11 show a third embodiment of this invention which is similar to the first embodiment in construction except for the omission of the spring 75 of the first embodiment and the provision of two post units in the third embodiment. In this embodiment, each of the post units includes a stud 51 which has a threaded upper end section 511 extending through one inner slot 721' in an auxiliary plate 72' and locked on the auxiliary plate 72' by means of a lock nut (N2), and a threaded lower end section 511' extending through a counterbore 52 in a bottom surface of a base 50' and locked on the base 50' by means of a lock nut (N3). The provision of the studs 51 can strengthen the strut unit of this invention.

Figure 12:
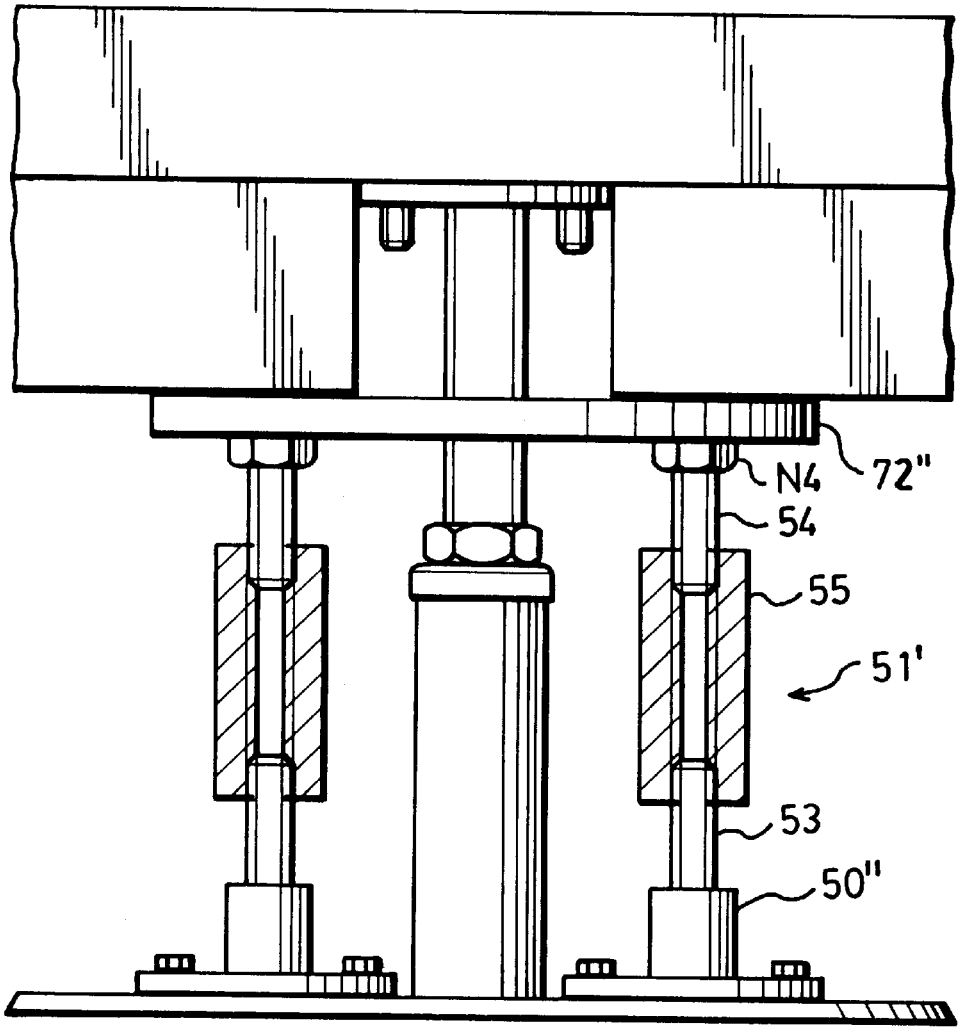
FIG. 12 shows a fourth preferred embodiment of this invention.

FIG. 12 shows a fourth preferred embodiment of this invention which is similar to the third embodiment in construction except that the studs 51 are replaced with two modified post units 51' and two modified bases 50" are provided to associate with the modified post units 51'. Each of the modified post units 51' includes an externally threaded lower post 53 fixed on the base 50", an externally threaded upper post 54 locked on an auxiliary plate 72" by means of a nut (N4), and an internally threaded adjusting tube 55 having an upper end section engaging threadably the upper post 54, and a lower end section engaging threadably the lower post 53. In each of the post units 51', when the adjusting tube 55 is rotated relative to the lower post 53 in one direction, the upper post 54 moves upward relative to the lower post 53. When the adjusting tube 55 is rotated relative to the lower post 53 in the opposite direction, the upper post 54 moves downward relative to the lower post 53.

With this invention thus explained, it is apparent that numerous modifications and variations can be made without departing from the spirit and scope of this invention. It is therefore intended that this invention be limited only as to the appended claims.

I claim:

1. A floor-supporting strut unit which supports and couples several spaced horizontal tubes on which floorboards can be mounted to form a floor, the tubes having sidewalls, comprising a base having a vertical tube with an open upper end;

a cap over the open upper end of the vertical tube, the cap having a threaded hole formed centrally therethrough;

an externally threaded vertical rod threadably engaging the threaded hole in the cap;

a stop nut threadably engaging the vertical rod and located above the cap, thereby supporting the stop nut on the cap; and a top plate fixed on an upper end of the vertical rod, the top plate having a plurality of equiangularly spaced coupling units, each of the coupling units having a fastener hole formed therethrough for use in fastening the tubes to the coupling unit when installed, and two open-ended parallel outer slots formed through an outer peripheral portion of said top plate on two sides of the fastener hole, the slots dimensioned to permit the side walls of the horizontal tubes to be placed in the slots in the top plate.

2. A floor-supporting strut unit as defined in claim 1, further comprising an auxiliary plate having a threaded hole formed centrally therethrough and threadingly engaging the vertical rod, the auxiliary plate being located between said top plate and said stop nut and having a plurality of radially extending inner slots which are equiangularly spaced from each other, each of said inner slots being formed through an intermediate portion of the auxiliary plate.

3. A floor-supporting strut unit as defined in claim 2, further comprising a plurality of post units which are positioned relative to the base and which are connected to the auxiliary plate in such a manner that the auxiliary plate can move vertically on said the post units, thereby cooperating with the vertical tubes to support horizontal tubes when the strut is in use.

4. A floor-supporting strut unit as claimed in claim 3, wherein each of the post units includes a lower post, an upper post, and an adjusting tube, the lower post being fixed on the base and having an externally threaded upper end section, the upper post being connected to the auxiliary plate and having an externally threaded lower end section, the adjusting tube having an internally threaded lower end section threadably engaging the externally threaded upper end section of the lower post, the adjusting tube having an internally threaded upper end section threadably engaging the externally threaded lower end section of the upper post, whereby rotation of the adjusting tube in one direction relative to the lower posts moves the upper and lower posts closer to each other and rotation of the adjusting tube in an opposing direction relative to the lower posts moves the upper and lower posts farther away from each other.

5. A floor-supporting strut unit as claimed in claim 1, further comprising a disk spring which is attached to the vertical rod and which is interposed between the cap and the stop nut, the disk spring having opposite sides which respectively abut a bottom of the stop nut and a top of the cap to absorb shock from the vertical rod.

6. A floor-supporting strut unit as claimed in claim 1, wherein the stop nut is seated against said cap, and the strut unit further comprises an auxiliary nut threadably engaged with the vertical rod with the auxiliary nut having a bottom that is seated on a top of the stop nut to prevent upward movement of the stop nut on the vertical rod.

7. A floor-supporting strut unit as claimed in claim 1, wherein the vertical tube has a diameter larger than a diameter of the stop nut.

* * * * *